US011431140B2

(12) United States Patent
Komoto et al.

(10) Patent No.: US 11,431,140 B2
(45) Date of Patent: Aug. 30, 2022

(54) COMPOSITE CONNECTOR

(71) Applicant: Japan Aviation Electronics Industry, Ltd., Tokyo (JP)

(72) Inventors: Tetsuya Komoto, Tokyo (JP); Akihiro Matsunaga, Tokyo (JP)

(73) Assignee: Japan Aviation Electronics Industry, Ltd., Tokyo (JP)

( * ) Notice: Subject to any disclaimer, the term of this patent is extended or adjusted under 35 U.S.C. 154(b) by 0 days.

(21) Appl. No.: 17/326,457

(22) Filed: May 21, 2021

(65) Prior Publication Data

US 2022/0045466 A1 Feb. 10, 2022

(30) Foreign Application Priority Data

Aug. 5, 2020 (JP) ..... JP2020-132889

(51) Int. Cl.
*H01R 13/60* (2006.01)
*H01R 35/04* (2006.01)
(Continued)

(52) U.S. Cl.
CPC ..... *H01R 35/04* (2013.01); *H01R 24/005* (2013.01); *H01R 13/512* (2013.01)

(58) Field of Classification Search
CPC ..... H01R 13/518; H01R 23/7073; H01R 13/514; H01R 9/2408; H01R 9/2675; H01R 23/025
See application file for complete search history.

(56) References Cited

U.S. PATENT DOCUMENTS 5,454,733 A 10/1995 Watanabe et al.
5,679,028 A * 10/1997 Yagi ..... H01R 13/518 439/701
(Continued)

FOREIGN PATENT DOCUMENTS

EP 3355414 A1 8/2018
JP H0278169 A 3/1990
(Continued)

OTHER PUBLICATIONS

European Search Report dated Dec. 17, 2021 in corresponding European Application 21183239.9.
(Continued)

*Primary Examiner* — Phuong Chi Thi Nguyen
(74) *Attorney, Agent, or Firm* — Renner, Otto, Boisselle & Sklar, LLP

(57) ABSTRACT

A composite connector that contributes to an improvement of workability for mating connectors with each other while preventing or reducing an increase in manufacturing cost is provided. A composite connector includes a first module including a first housing in which a first connector is exposed, and a second housing rotatable about the first housing, the second housing including a second connector, and a second module including a third connector, and a third housing including a fourth connector, the third connector being configured to be mated with and connected to the first connector. The composite connector is configured so that the second and fourth connectors are mated with each other in a state in which one of a projection and a recess that is formed in the second housing is mated with the other of the projection and the recess that is formed in the third housing.

8 Claims, 16 Drawing Sheets

(51) Int. Cl.
*H01R 24/00* (2011.01)
*H01R 13/512* (2006.01)

(56) References Cited

U.S. PATENT DOCUMENTS

| | | | | |
|---|---|---|---|---|
| 5,855,496 | A * | 1/1999 | Lokken | B63H 20/10 440/53 |
| 6,307,153 | B2 * | 10/2001 | Imoto | H05K 7/1481 174/50 |
| 9,011,173 | B2 * | 4/2015 | Osada | H01R 13/518 439/527 |
| 9,257,788 | B1 * | 2/2016 | Jia | G06F 1/187 |
| 9,484,657 | B2 * | 11/2016 | Martin | H01R 13/4361 |
| 2012/0190235 | A1 * | 7/2012 | Sakurai | H01R 27/02 439/540.1 |
| 2012/0276781 | A1 | 11/2012 | Nishijima | |
| 2018/0219326 | A1 | 8/2018 | Matsuo et al. | |
| 2018/0219342 | A1 | 8/2018 | Matsuo et al. | |

FOREIGN PATENT DOCUMENTS

| | | | |
|---|---|---|---|
| JP | H04154062 | A | 5/1992 |
| JP | 2012-138244 | A | 7/2012 |
| JP | 2012-234687 | A | 11/2012 |
| JP | 2018-125084 | A | 8/2018 |
| JP | 2018-125095 | A | 8/2018 |

OTHER PUBLICATIONS

European Office Action dated Jan. 10, 2022 in corresponding European Application 21183239.9.

* cited by examiner

COMPOSITE CONNECTOR

INCORPORATION BY REFERENCE

This application is based upon and claims the benefit of priority from Japanese patent application No. 2020-132889, filed on Aug. 5, 2020, the disclosure of which is incorporated herein in its entirety by reference.

BACKGROUND

The present disclosure relates to a composite connector.

As shown in FIG. 16 of the present disclosure, Japanese Unexamined Patent Application Publication No. 2012-138244 discloses a module 100 that forms a composite connector with a counterpart module. The module 100 includes a housing 101 and a plurality of connectors 102.

Note that the plurality of connectors 102 are disposed in the housing 101 so that they are mated with a plurality of connectors of the counterpart module in one direction. Therefore, the mating directions of the plurality of connectors 102 are aligned with those of the plurality of connectors of the counterpart module in one direction.

SUMMARY

As described above, in the configuration disclosed in Japanese Unexamined Patent Application Publication No. 2012-138244, the mating directions of the plurality of connectors 102 of the module 100 and those of the counterpart module are aligned with each other in one direction. Therefore, it is necessary to accurately dispose the plurality of connectors 102 in the housing 101, causing a problem that the manufacturing cost of the module 100 increases.

Further, it is difficult to align the plurality of connectors 102 of the module 100 and those of the counterpart module with each other in order to mate them with each other, causing a problem that workability for mating the connectors with each other is poor.

An object of the present disclosure is to provide a composite connector that contributes to an improvement of workability for mating connectors with each other while preventing or reducing an increase in manufacturing cost.

A composite connector according to an aspect of the present disclosure includes:

a first module including a first housing in which a first connector is exposed from a distal end thereof, and a second housing rotatable about the first housing, the second housing including a second connector; and a second module including a third connector, and a third housing including a fourth connector, the third connector being configured to be mated with and electrically connected to the first connector, and the fourth connector being configured to be mated with and electrically connected to the second connector, in which the composite connector is configured so that the second and fourth connectors are mated with each other in a state in which one of a projection and a recess that is formed in the second housing is mated with the other of the projection and the recess that is formed in the third housing.

According to the present disclosure, the above-described features contribute to an improvement of workability for mating connectors with each other while preventing or reducing an increase in manufacturing cost.

The above and other objects, features and advantages of the present disclosure will become more fully understood from the detailed description given hereinbelow and the accompanying drawings which are given by way of illustration only, and thus are not to be considered as limiting the present disclosure.

DESCRIPTION OF EMBODIMENTS

Embodiments are described hereinafter with reference to FIGS. 1 to 15. Firstly, a configuration of a composite connector according to this embodiment is described. Note that the configuration of the composite connector is described hereinafter by using an orthogonal coordinate system (an XYZ-coordinate system) in order to clarify the description.

Figure 1:
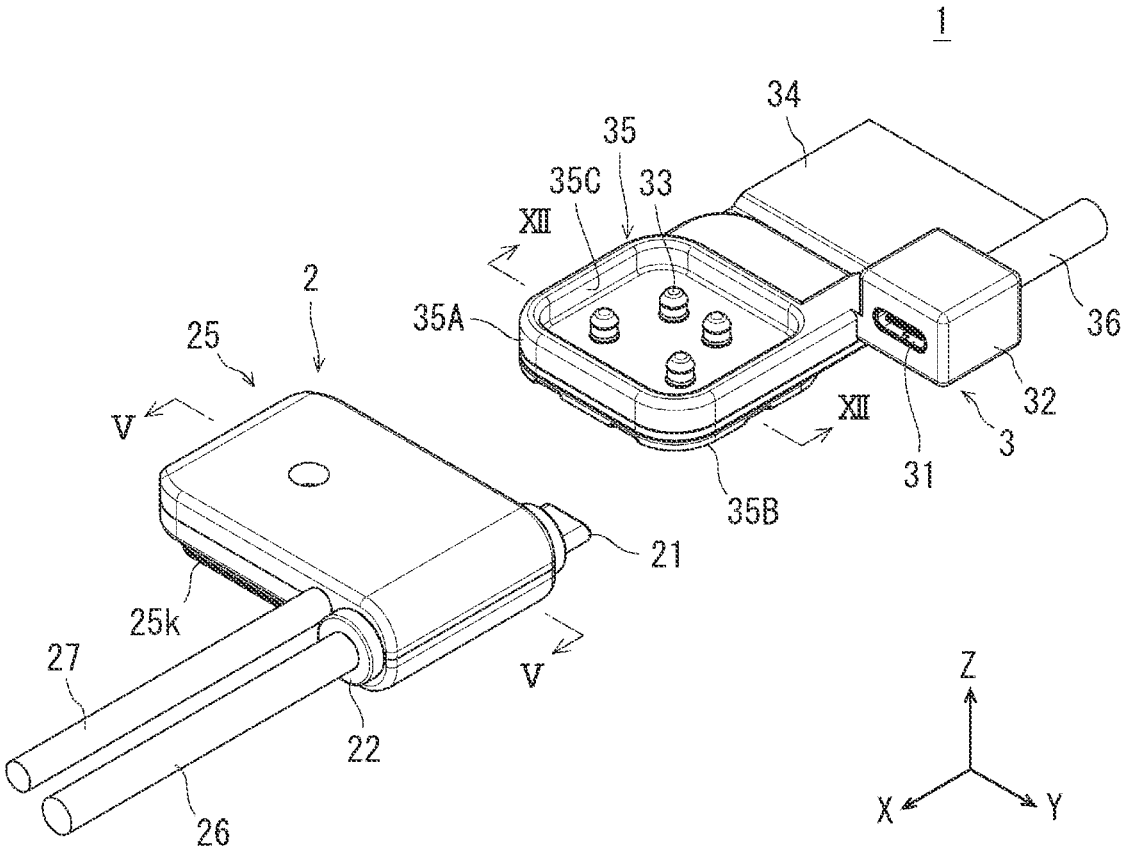
FIG. 1 is a perspective view of a composite connector according to an embodiment as viewed from the Z-axis positive side, in which a first module and a second module are unmated.
Figure 2:
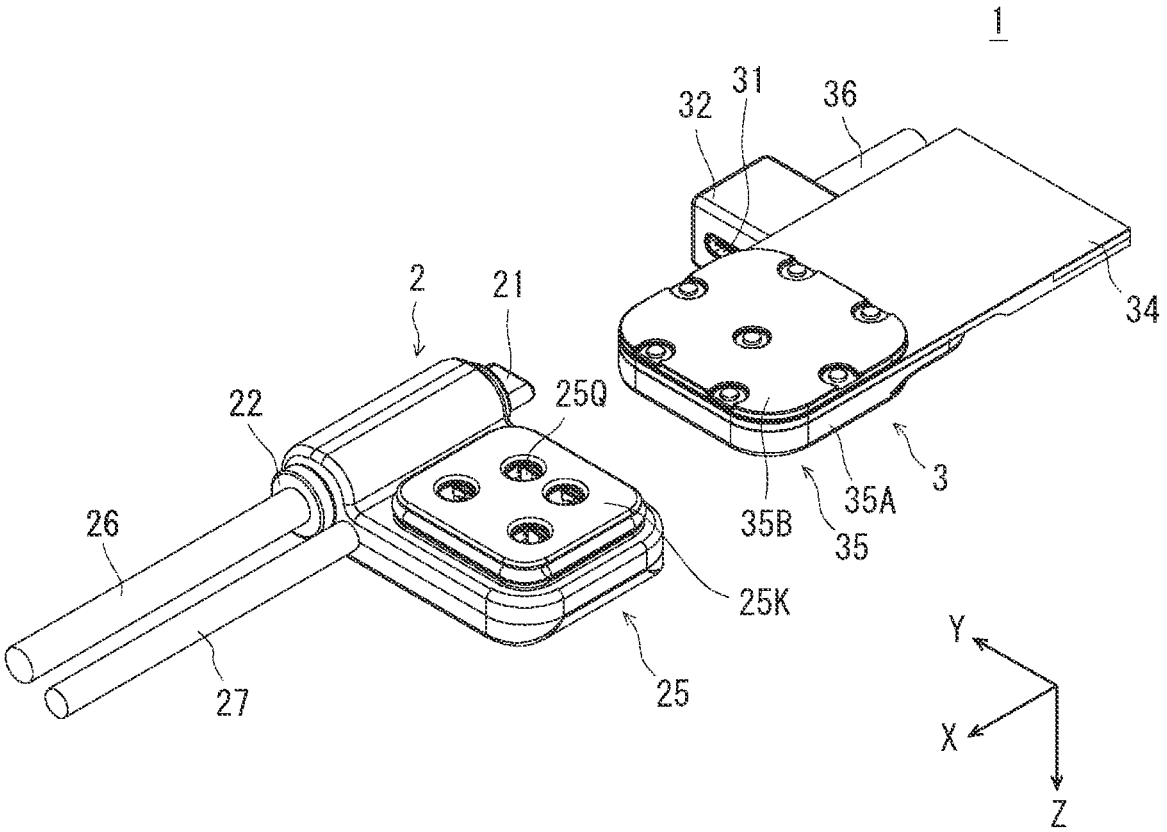
FIG. 2 is a perspective view of the composite connector according to the embodiment as viewed from the Z-axis negative side, in which the first and second modules are unmated.

FIG. 1 is a perspective view of a composite connector according to this embodiment as viewed from the Z-axis positive side, in which a first module and a second module are unmated. FIG. 2 is a perspective view of the composite connector according to this embodiment as viewed from the Z-axis negative side, in which the first and second modules are unmated.

Figure 3:
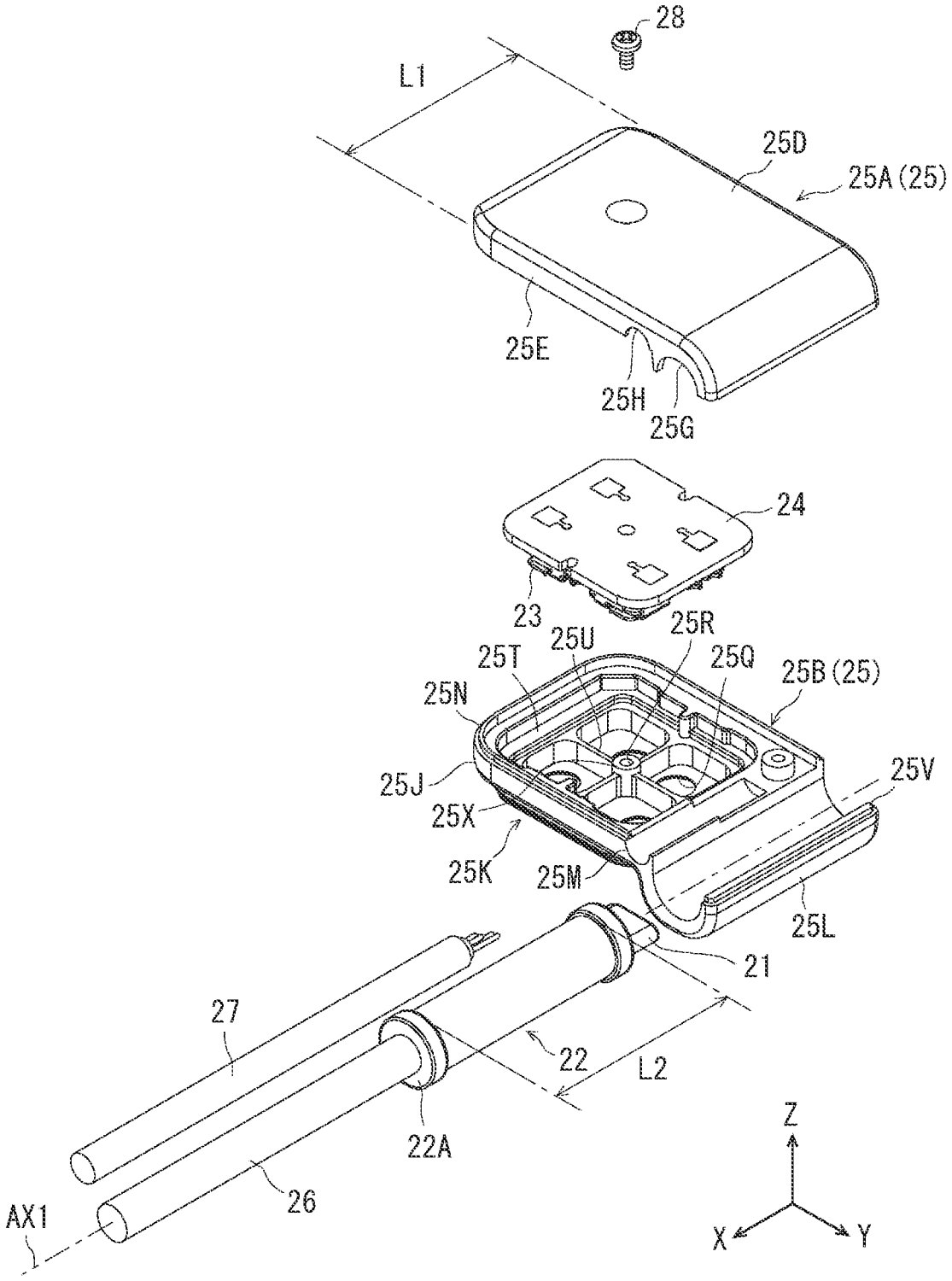
FIG. 3 is an exploded perspective view of the first module according to the embodiment as viewed from the Z-axis positive side.
Figure 4:
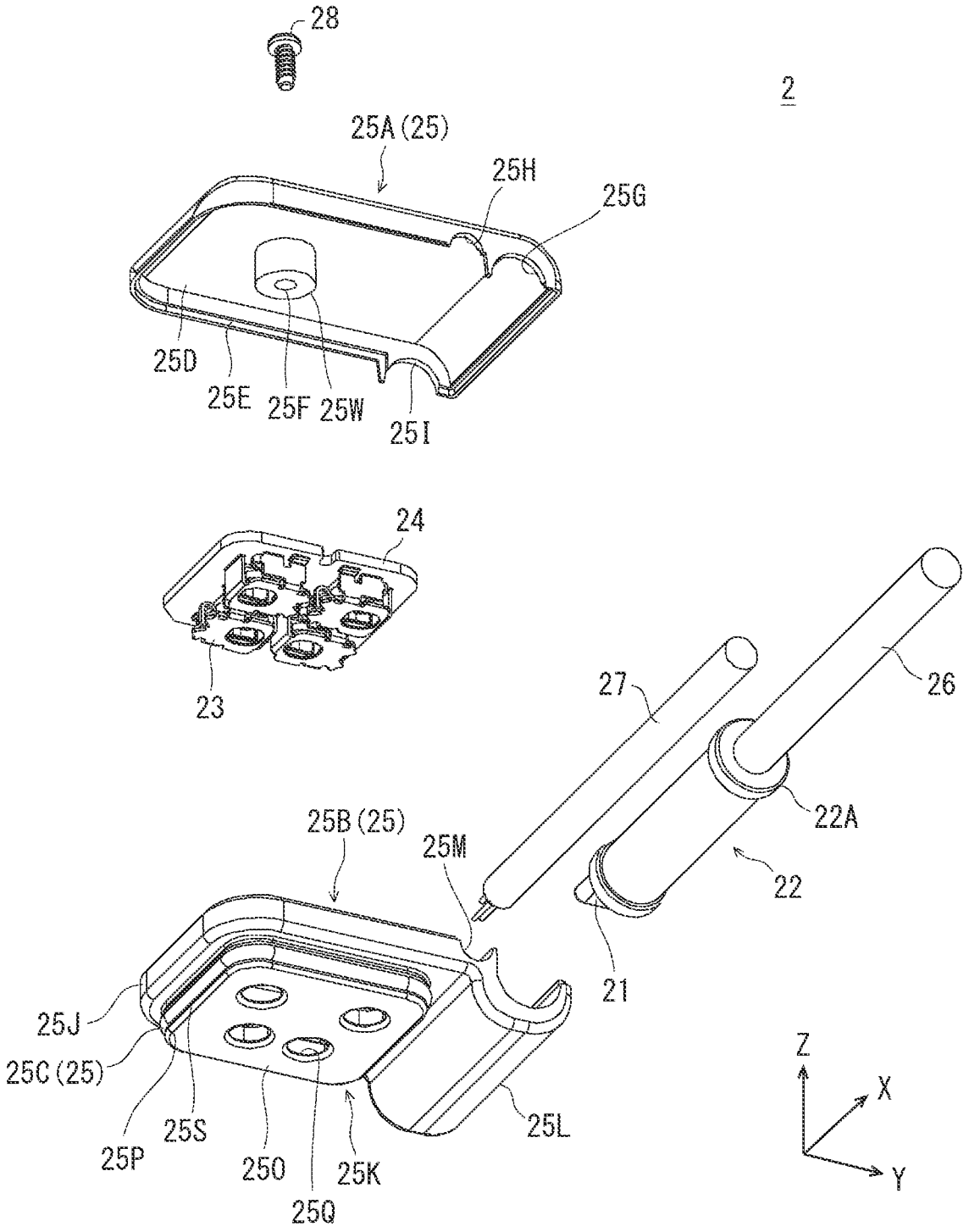
FIG. 4 is an exploded perspective view of the first module according to the embodiment as viewed from the Z-axis negative side.
Figure 5:
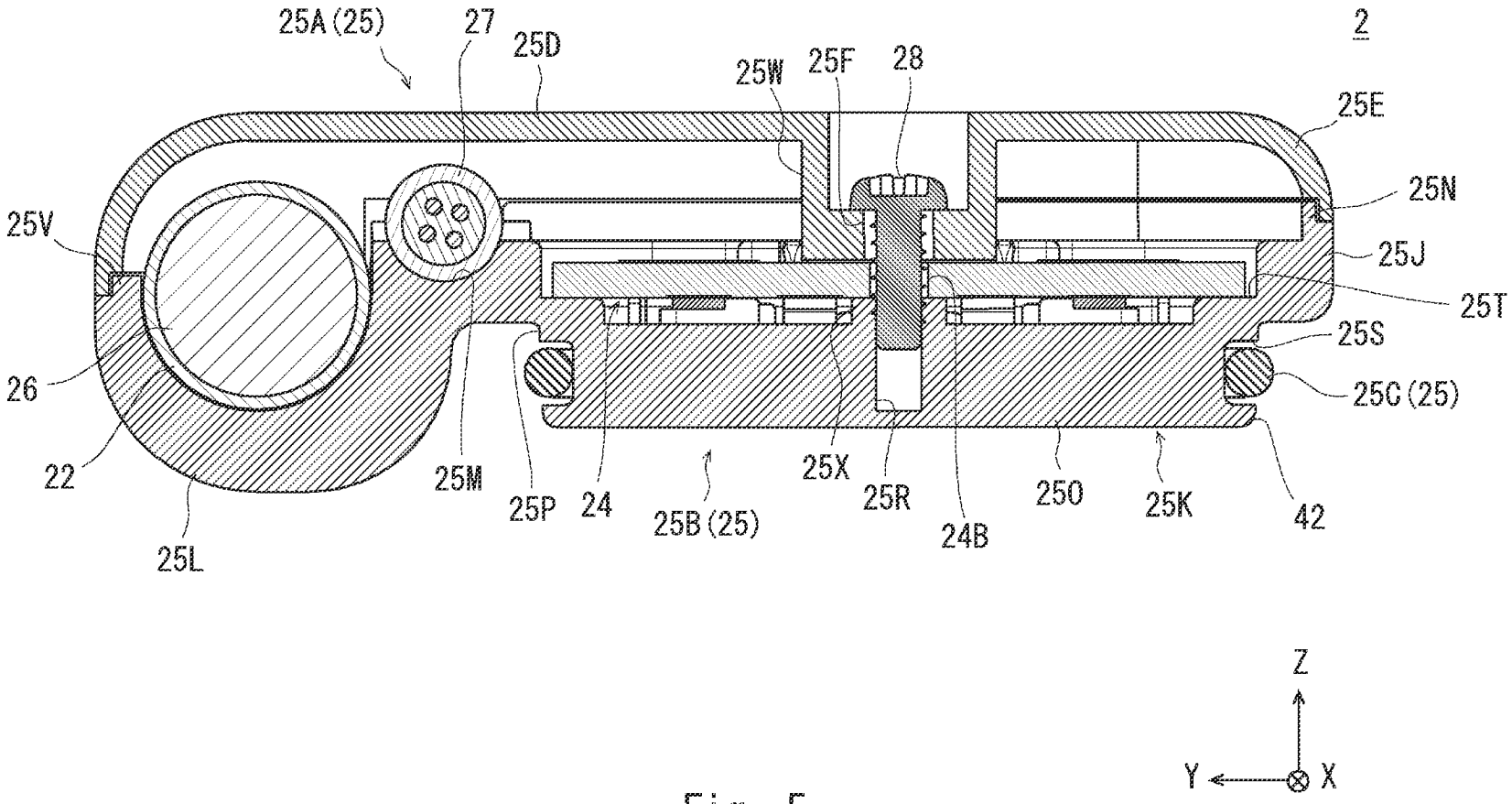
FIG. 5 is a cross-sectional view at a part indicated by arrows V-V in FIG. 1.

As shown in FIGS. 1 and 2, the composite connector 1 includes a first module 2 and a second module 3. A configuration of the first module 2 is described. FIG. 3 is an exploded perspective view of the first module according to this embodiment as viewed from the Z-axis positive side. FIG. 4 is an exploded perspective view of the first module according to this embodiment as viewed from the Z-axis negative side. FIG. 5 is a cross-sectional view at a part indicated by arrows V-V in FIG. 1.

As shown in FIGS. 3 and 4, the first module 2 includes a first connector 21, a first housing 22, a second connector 23, a substrate 24, and a second housing 25. The first connector 21 is, for example, one of a pair of micro USB Type-B type connectors.

As shown in FIGS. 3 to 5, the first housing 22 has a hollow columnar shape as its basic form and extends in the X-axis direction. That is, the central axis AX1 of the first housing 22 extends in the X-axis direction. Annular flange parts 22A project in the radial direction of the first housing 22 from the ends on the X-axis positive side and the X-axis negative side of an outer peripheral side surface of the first housing 22. The above-described first housing 22 is preferably a resin-molded article.

As shown in FIGS. 3 and 4, the first connector 21 is fixed on the surface on the X-axis negative side of the first housing 22. As a result, the first connector 21 projects from the surface on the X-axis negative side of the first housing 22 toward the X-axis negative side. Further, as shown in FIG. 5, a first wire 26, which is inserted into the first housing 22, is electrically connected to the first connector 21. The first wire 26 extends from the first connector 21 toward the X-axis positive side. Note that, in FIG. 5, the first wire 26 and the like are shown in a simplified manner for clarifying the drawing.

Figure 6:
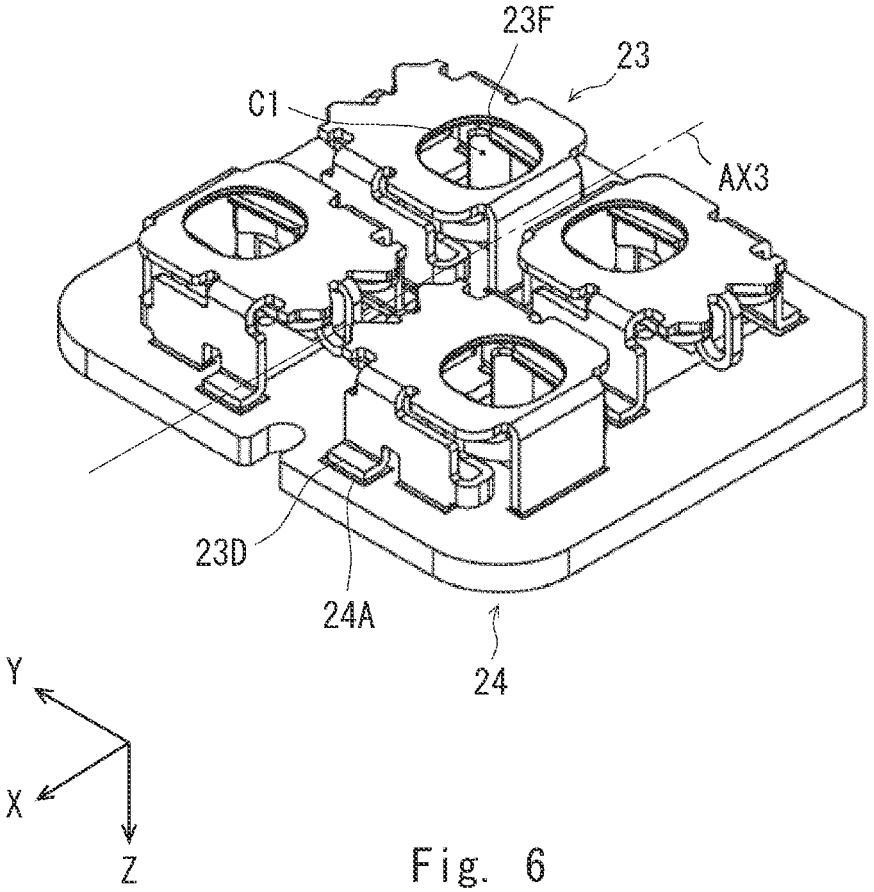
FIG. 6 is a perspective view of an embodiment as viewed from the Z-axis negative side, in which a second connector is electrically connected to a substrate.
Figure 7:
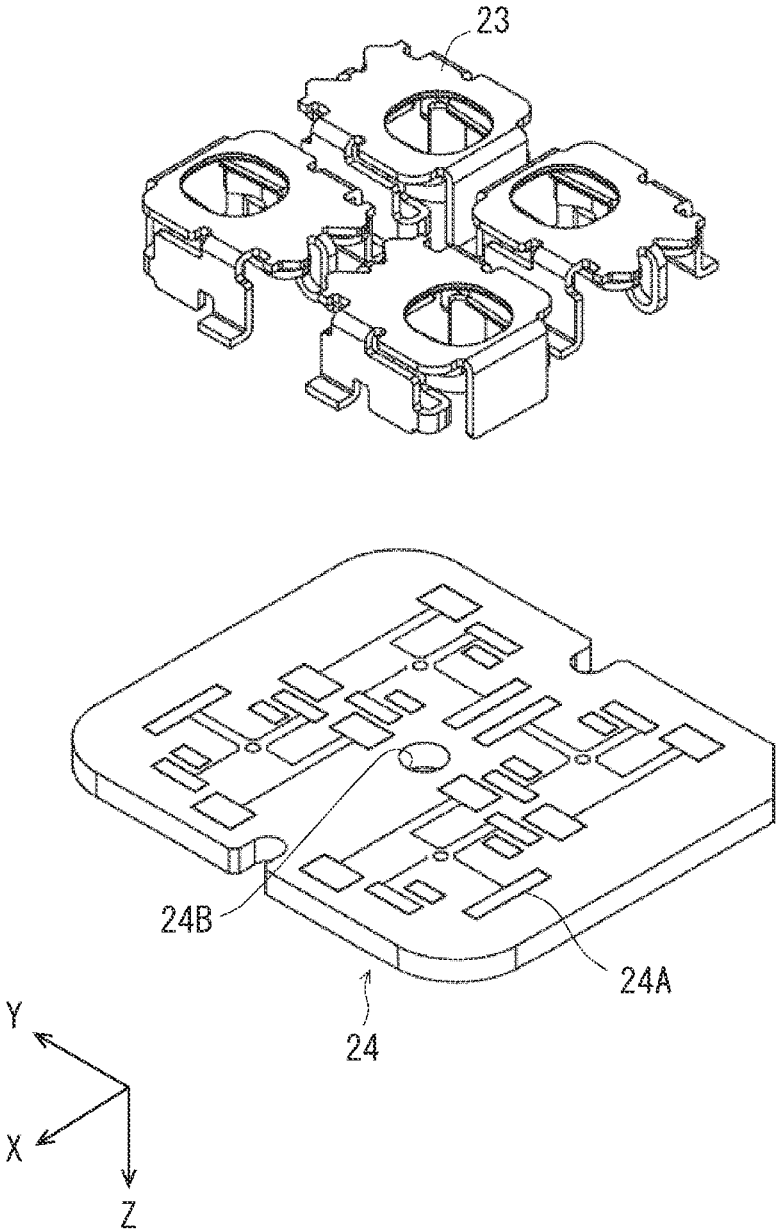
FIG. 7 is an exploded perspective view of the second connector and the substrate according to the embodiment as viewed from the Z-axis negative side.
Figure 8:
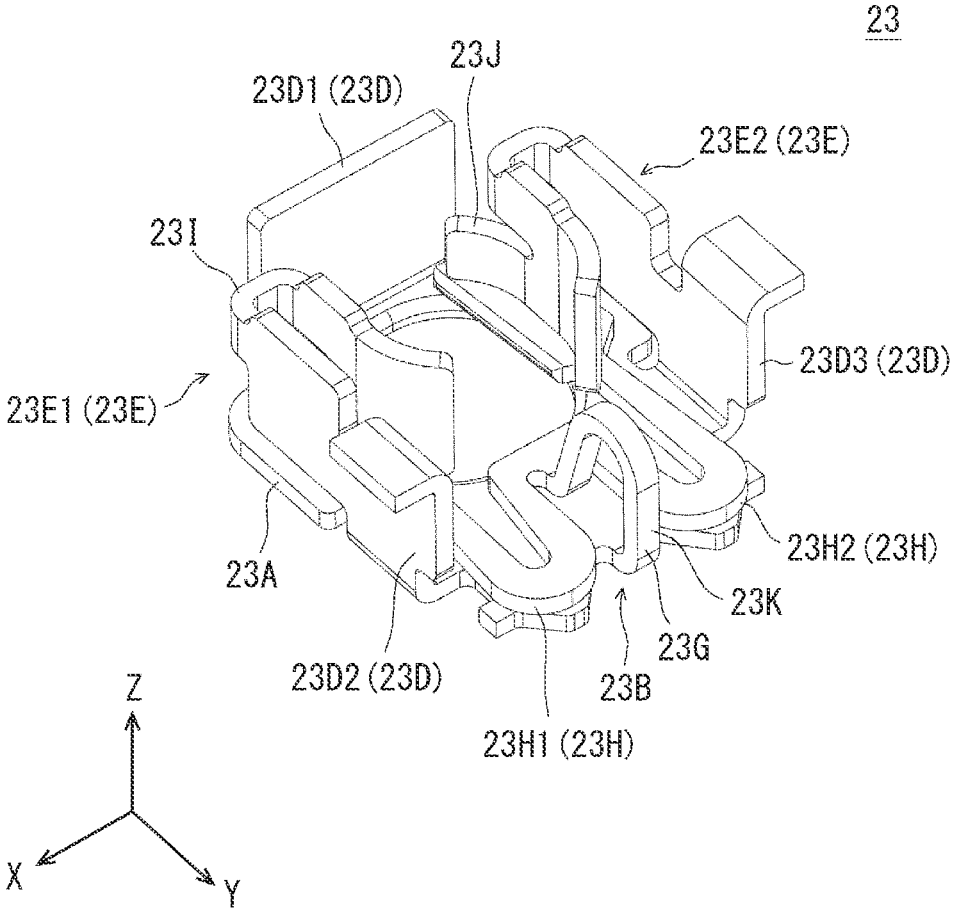
FIG. 8 is a perspective view of the second connector according to the embodiment as viewed from the Z-axis positive side.
Figure 9:
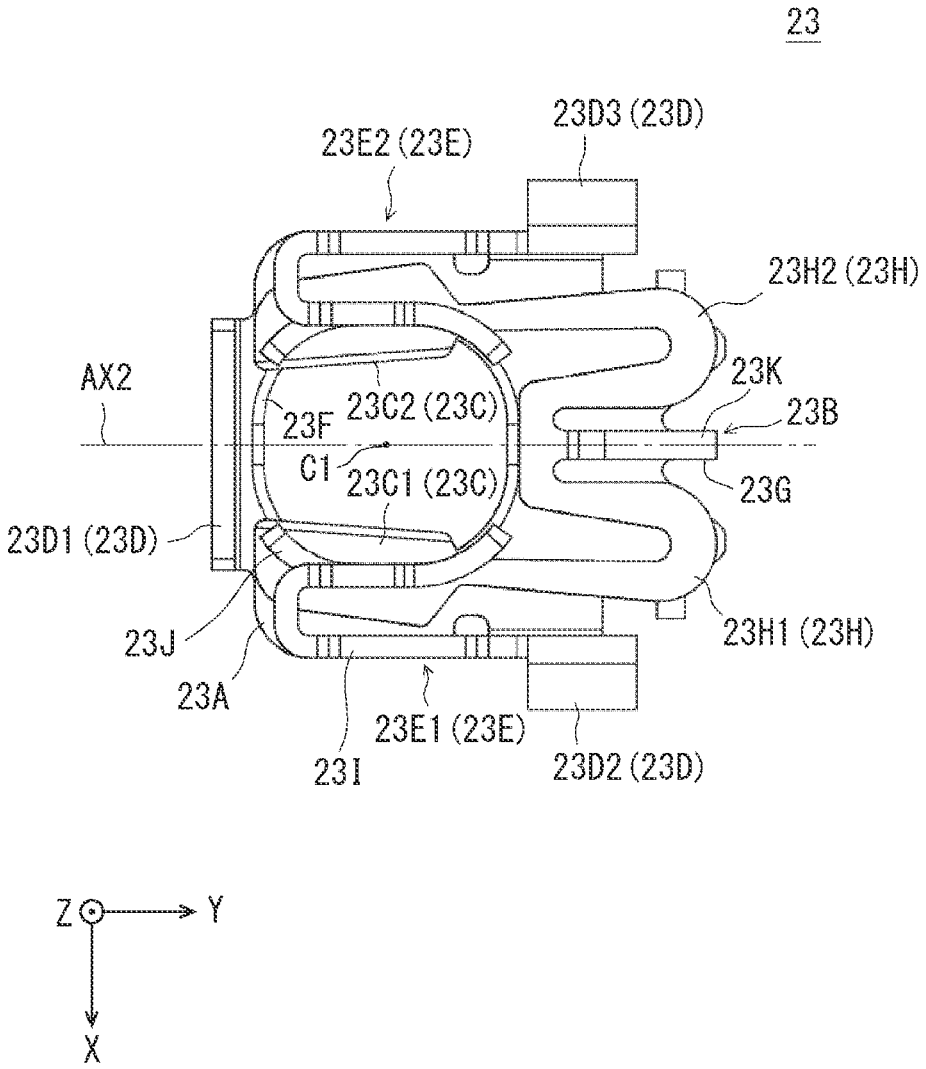
FIG. 9 is a plan view of the second connector according to the embodiment as viewed from the Z-axis positive side.
Figure 10:
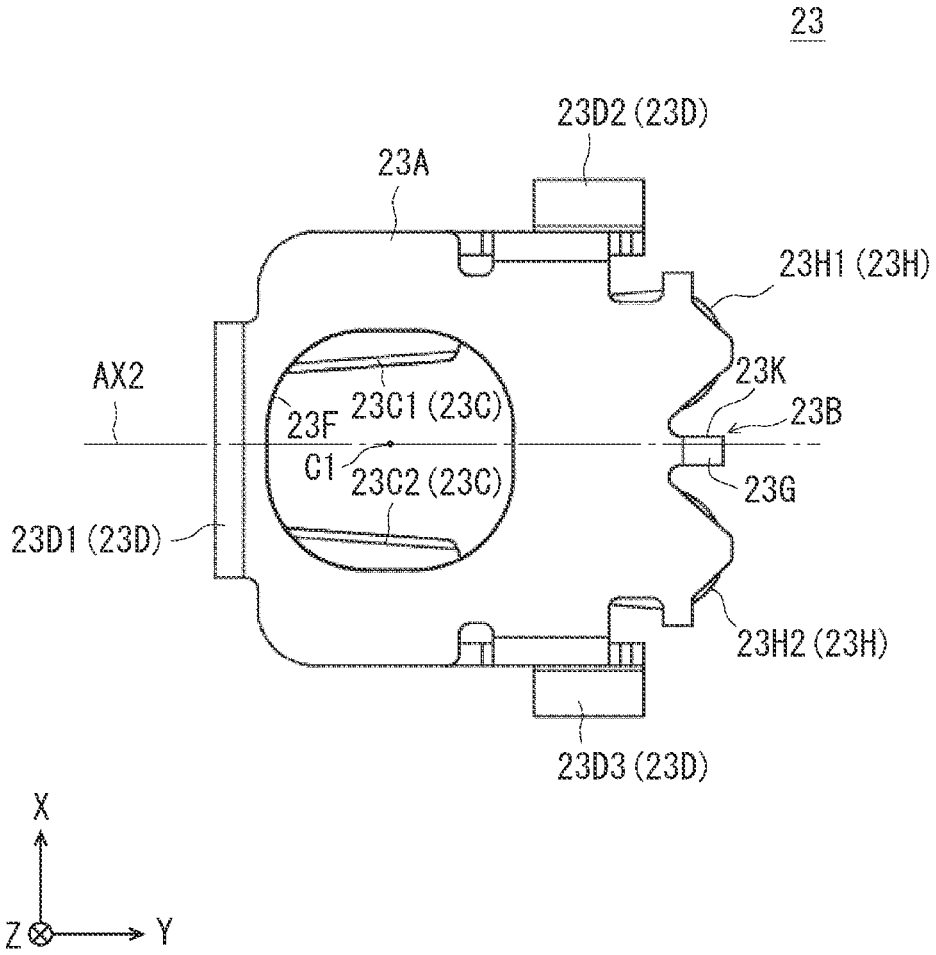
FIG. 10 is a bottom view of the second connector according to the embodiment as viewed from the Z-axis negative side.

FIG. 6 is a perspective view of this embodiment as viewed from the Z-axis negative side, in which the second connector is electrically connected to the substrate. FIG. 7 is an exploded perspective view of the second connector and the substrate according to this embodiment as viewed from the Z-axis negative side. FIG. 8 is a perspective view of the second connector according to this embodiment as viewed from the Z-axis positive side. FIG. 9 is a plan view of the second connector according to this embodiment as viewed from the Z-axis positive side. FIG. 10 is a bottom view of the second connector according to this embodiment as viewed from the Z-axis negative side. Note that FIGS. 8 to 10 show, among the four second connectors 23 shown in FIGS. 6 and 7, the second connector 23 disposed on the X-axis negative side and on the Y-axis positive side as a representative example of these second connectors.

As shown in FIGS. 6 to 10, the second connector 23 includes a base part 23A, an arm part 23B, a pair of contact-point parts 23C, a substrate mounting part 23D, and a pair of contact guide parts 23E. Further, the second connector 23 is formed, for example, by bending a single metal plate. Note that the following description of the configuration of the second connector 23 is given with reference to the second connector 23 shown in FIGS. 8 to 10 as a representative example.

As shown in FIGS. 8 to 10, the base part 23A includes a flat part roughly parallel to the XY-plane. Further, a penetrating part 23F that extends through the base part 23A in the Z-axis direction is formed in the base part 23A. The arm part 23B includes a root part 23G and a pair of branch parts 23H, and is disposed so as not to be exposed in the penetrating part 23F of the base part 23A as viewed in the Z-axis direction.

As shown in FIG. 9, the root part 23G is disposed on a first axis AX2 that passes through the center C1 of the penetrating part 23F of the base part 23A and extends in the Y-axis direction. As shown in FIG. 8, for example, the root part 23G has a roughly U-shape as viewed in the X-axis direction, and its end located on the Y-axis positive side of the root part 23G and on the Z-axis negative side thereof is fixed to the end on the Y-axis positive side of the base part 23A. That is, the root part 23G projects from the end on the Y-axis positive side of the base part 23A toward the Z-axis positive side, is bent so as to be curved into the Y-axis negative side, and extends toward the Z-axis negative side.

As shown in FIG. 9, the pair of branch parts 23H extend from the end of the root part 23G on the Y-axis negative side and on the Z-axis negative side, and are branched to the X-axis positive side and to the X-axis negative side. Specifically, the pair of branch parts 23H have an axial-symmetrical shape with respect to the first axis AX2. Therefore, in this embodiment, the branch parts 23H include a first branch part 23H1 disposed on the X-axis positive side and a second branch part 23H2 disposed on the X-axis negative side.

As shown in FIG. 9, since the first branch part 23H1 and the second branch part 23H2 have the axial-symmetrical shape with respect to the first axis AX2, only the first branch part 23H1 is described hereinafter as a representative example. The first branch part 23H1 has, for example, a roughly U-shape as viewed in the Z-axis direction, and its end located on the X-axis negative side of the first branch part 23H1 and on the Y-axis negative side thereof is fixed to the end of the root part 23G on the Y-axis negative side and on the Z-axis negative side. That is, the first branch part 23H1 projects from the end of the root part 23G on the Y-axis negative side and on the Z-axis negative side toward the Y-axis positive side, is bent so as to be curved into the X-axis positive side, and extends toward the Y-axis negative side.

As shown in FIG. 9, the pair of contact-point parts 23C are axial-symmetrically disposed with respect to the first axis AX2. Therefore, in this embodiment, the pair of contact-point parts 23C includes a first contact-point part 23C1 disposed on the X-axis positive side and a second contact-point part 23C2 disposed on the X-axis negative side.

As shown in FIG. 9, since the first contact-point part 23C1 and the second contact-point part 23C2 are axial-symmetrically disposed with respect to the first axis AX2, only the first contact-point part 23C1 is described as a representative example. The first contact-point part 23C1 projects from the end of the first branch part 23H1 on the X-axis positive side and on the Y-axis negative side toward the Y-axis negative side.

As shown in FIG. 10, the part of the first contact-point part 23C1 that is opposed to the second contact-point part 23C2 in the X-axis direction is exposed in the penetrating part 23F of the base part 23A. As shown in FIG. 9, the part of the first contact-point part 23C1 opposed to the second contact-point part 23C2 extends roughly in the Y-axis direction. That is, the part of the first contact-point part 23C1 opposed to the second contact-point part 23C2 extends roughly in a direction perpendicular to the central axis AX1 of the first housing 22. Further, as shown in FIG. 8, chamfered parts are formed at the ends on the Z-axis positive side and on the Z-axis negative side of the part of the first contact-point part 23C1 opposed to the second contact-point part 23C2.

Note that the part of the first contact-point part 23C1 opposed to the second contact-point part 23C2 and the part of the second contact-point part 23C2 opposed to the first contact-point part 23C1 are preferably disposed so that the distance between them becomes slightly larger toward the Y-axis positive side.

The substrate mounting part 23D is a part that is used to electrically connect the second connector 23 to the substrate 24. For example, as shown in FIGS. 8 to 10, in this embodiment, the substrate mounting part 23D includes a first substrate mounting part 23D1, a second substrate mounting part 23D2, and a third substrate mounting part 23D3.

As shown in FIG. 8, the first substrate mounting part 23D1 extends from the end on the Y-axis negative side of the base part 23A toward the Z-axis positive side, and has, for example, a roughly rectangular shape as viewed in the Y-axis direction. The second substrate mounting part 23D2 projects from the end on the X-axis positive side of the base part 23A toward the Z-axis positive side, and is disposed on the X-axis positive side with respect to the first branch part 23H1. The second substrate mounting part 23D2 has, for example, a roughly L-shape as viewed in the Y-axis direction, in which the part on the Z-axis positive side of the second substrate mounting part 23D2 is bent toward the X-axis positive side.

As shown in FIG. 8, the third substrate mounting part 23D3 projects from the end on the X-axis negative side of the base part 23A toward the Z-axis positive side, and is disposed on the X-axis negative side with respect to the second branch part 23H2. The third substrate mounting part 23D3 has, for example, a roughly L-shape as viewed in the Y-axis direction, in which the part on the Z-axis positive side of the third substrate mounting part 23D3 is bent toward the X-axis negative side. The heights of the first substrate mounting part 23D1, the second substrate mounting part 23D2, and the third substrate mounting part 23D3 in the Z-axis direction are roughly equal to each other, and are higher than the height of the arm part 23B in the Z-axis direction.

The pair of contact guide parts 23E are parts that are used to prevent the contact-point part 23C from being excessively displaced toward the Z-axis negative side. As shown in FIG. 9, for example, the pair of contact guide parts 23E are axial-symmetrically disposed with respect to the first axis AX2. Therefore, in this embodiment, the pair of contact guide parts 23E include a first contact guide part 23E1 disposed on the X-axis positive side and a second contact guide part 23E2 disposed on the X-axis negative side.

As shown in FIG. 9, since the first contact guide part 23E1 and the second contact guide part 23E2 are axial-symmetrically disposed with respect to the first axis AX2, only the first contact guide part 23E1 is described hereinafter as a representative example. As shown in FIGS. 8 and 9, the first contact guide part 23E1 includes a support part 231 and a contact part 23J.

As shown in FIG. 9, the support part 231 has a roughly U-shape as viewed in the Z-axis direction, and its end on the X-axis positive side of the support part 231 and on the Y-axis positive side thereof is fixed to the end on the Y-axis negative side of the second substrate mounting part 23D2. That is, the support part 231 projects from the end on the Y-axis negative side of the second substrate mounting part 23D2 toward the Y-axis negative side, is bent so as to be curved into the X-axis negative side, and extends toward the Y-axis positive side.

As shown in FIG. 9, the contact part 23J has a curved shape conforming to the peripheral edge of the penetrating part 23F of the base part 23A. The contact part 23J is disposed between the part of the support part 231 that extends toward the Y-axis positive side and the first contact-point part 23C1, and its end on the Y-axis positive side of the contact part 23J and on the Z-axis positive side thereof is fixed to the part of the support part 231 extending toward the Y-axis positive side. In this way, the contact part 23J is supported by the support part 231.

The above-described second connector 23 has a structure in which the contact-point part 23C is fixed to the base part 23A through the arm part 23B. Further, the part of the arm part 23B that extends to the Z-axis positive side of the root part 23G is elastically twisted and deformed around the Z-axis, so that the pair of contact-point parts 23C are displaced in the X-axis direction on the XY-plane. That is, the part of the arm part 23B extending to the Z-axis positive side of the root part 23G functions as a displacement allowance part 23K of the pair of contact-point parts 23C.

As shown in FIG. 7, the substrate 24 includes a wiring-line pattern 24A on the surface on the Z-axis negative side of the substrate 24. A bolt hole 24B that extends through the substrate 24 in the Z-axis direction is formed in the substrate 24. A second wire 27 is electrically connected to the wiring-line pattern 24A of the above-described substrate 24. Further, as shown in FIG. 6, the substrate mounting part 23D of the second connector 23 is electrically connected to the wiring-line pattern 24A of the substrate 24 by welding such as soldering.

Note that, as shown in FIG. 6, the penetrating parts 23F of the base part 23A of the second connector 23 are preferably disposed so that their centers C1 are not aligned with each other in the X-axis direction. Details of the function of this feature are described later. For example, the penetrating parts 23F of the base part 23A of the second connector 23 are preferably disposed so that their centers C1 are positioned at the vertexes of an isosceles trapezoid having a short side on the X-axis negative side as viewed in the Z-axis direction.

Therefore, the second connector 23 is axial-symmetrically disposed with respect to a second axis AX3 extending in the X-axis direction. Note that, for example, as shown in FIG. 6, the two second connectors 23 disposed on the X-axis positive side are disposed so that the arm part 23B is opposed to them with the second axis AX3 interposed therebetween, and the two second connectors 23 disposed on the X-axis negative side are disposed so that the first substrate mounting part 23D1 is opposed to them with the second axis AX3 interposed therebetween.

Referring to FIGS. 3 to 5 again, the second housing 25 includes a first case 25A, a second case 25B, and a gasket 25C. The length L1 of the second housing 25 in the X-axis direction is shorter than the distance L2 between the flange parts 22A of the first housing 22.

The first case 25A is preferably, for example, a resin-molded article. As shown in FIGS. 3 and 4, the first case 25A is opened on the Z-axis negative side, and includes a ceiling part 25D and a side-wall part 25E. The ceiling part 25D has a roughly rectangular shape as viewed in the Z-axis direction. As shown in FIGS. 4 and 5, a bolt hole 25F is formed in the ceiling part 25D so as to extend through a boss part 25W that projects from the ceiling part 25D toward the Z-axis negative side. The bolt hole 25F extends through the boss part 25W in the Z-axis direction.

As shown in FIG. 4, the side-wall part 25E is disposed along the peripheral edge of the ceiling part 25D and projects from the ceiling part 25D toward the Z-axis negative side. In the part on X-axis positive side of the side-wall part 25E, a roughly semicircular first cut-out part 25G in which the part on the Z-axis positive side of the first housing 22 is accommodated, and a roughly semicircular second cut-out part 25H in which the part on the Z-axis positive side of the second wire 27 is accommodated are formed. In the part on the X-axis negative side of the side-wall part 25E, a roughly semicircular third cut-out part 25I in which the part on the Z-axis positive side of the first housing 22 is accommodated is formed. Note that the part on the Y-axis positive side of the side-wall part 25E preferably has a curved shape conforming to the outer peripheral side surface of the first housing 22.

The second case 25B is preferably, for example, a resin-molded article. As shown in FIGS. 3 to 5, the second case 25B includes a pedestal part 25J, a bulging part 25K, and an arm part 25L. As shown in FIG. 3, the pedestal part 25J has a roughly rectangular annular shape as viewed in the Z-axis direction, and an accommodation part 25M having a roughly semicircular columnar shape that accommodates the part on the Z-axis negative side of the second wire 27 is formed on the surface on the Z-axis positive side of the pedestal part 25J.

Note that, as shown in FIG. 3, a first guide part 25N is preferably formed along the peripheral edge of the pedestal part 25J so that the position of the first case 25A is guided with respect to the second case 25B when the first case 25A and the second case 25B are butted against each other and fixed to each other. The first guide part 25N projects from the pedestal part 25J toward the Z-axis positive side.

As shown in FIG. 5, when the first case 25A and the second case 25B are butted against each other, the first guide part 25N comes into contact with the inner peripheral surface of the part on the X-axis positive side part of the side-wall part 25E of the first case 25A, that of the part on the Y-axis negative side part thereof, and that of the part on the X-axis negative side thereof.

As shown in FIGS. 3 and 4, the bulging part 25K projects from the pedestal part 25J toward the Z-axis negative side. The bulging part 25K is opened on the Z-axis positive side, and includes a bottom part 25O and a side-wall part 25P. The bottom part 25O has a roughly rectangular shape as viewed in the Z-axis direction. In the bottom part 25O, a penetrating part 25Q is formed in a place corresponding to the penetrating part 23F of the base part 23A of the second connector 23 fixed to the substrate 24. Further, as shown in FIGS. 3 and 5, in the bottom part 25O, a bolt hole 25R is formed in a boss part 25X that projects from the bottom part 25O toward the Z-axis positive side.

As shown in FIGS. 4 and 5, the side-wall part 25P is disposed along the peripheral edge of the bottom part 25O and projects from the bottom part 25O toward the Z-axis positive side. A groove part 25S is formed on the outer side surface of the side-wall part 25P so as to surround the outer side surface of the side-wall part 25P.

Note that, as shown in FIG. 5, the part of the side-wall part 25P that is located on the Z-axis negative side with respect to the groove part 25S on the Y-axis negative side is preferably disposed on the Y-axis positive side with respect to the part of the side-wall part 25P that is located on the Z-axis positive side with respect to the groove part 25S on the Y-axis negative side. Details of the function of this feature are described later.

The substrate 24 and the second connector 23 are accommodated in a space surrounded by the bottom part 25O and the side-wall part 25P as described above. Note that as shown in FIGS. 3 and 5, a step part 25T on which the substrate 24 is placed is preferably formed in the part on the Z-axis positive side of the side-wall part 25P. Further, the space surrounded by the bottom part 25O and the side-wall part 25P is preferably divided, by partition walls 25U, into a plurality of spaces in which respective second connectors 23 are accommodated.

As shown in FIGS. 3 to 5, the arm part 25L has a roughly semi-cylindrical shape as viewed in the X-axis direction, and its end located on the Y-axis negative side of the arm part 25L and the Z-axis positive side thereof is fixed to the end on the Y-axis positive side of the pedestal part 25J. The part on the Z-axis negative side of the first housing 22 is accommodated inside the arm part 25L.

Note that as shown in FIGS. 3 and 5, a second guide part 25V is preferably formed at the end on the Y-axis positive side of the arm part 25L and on the Z-axis positive side thereof, so that the position of the first case 25A is guided with respect to the second case 25B when the first case 25A and the second case 25B are butted against each other and fixed to each other. The second guide part 25V extends in the X-axis direction, and projects from the end of the arm part 25 L on the Y-axis positive side and on the Z-axis positive side toward the Z-axis positive side.

As shown in FIG. 5, when the first case 25A and the second case 25B are butted against each other, the second guide part 25V comes into contact with the inner peripheral surface of the part of the first case 25A disposed on the Y-axis positive side of the side-wall part 25E. The gasket 25C has a roughly rectangular annular shape and is mated with the groove part 25S of the bulging part 25K.

Next, a flow of assembling of the first module 2 is described. Firstly, the substrate mounting part 23D of the second connector 23 is electrically connected to the wiring-line pattern 24A of the substrate 24. Then, the second wire 27 is electrically connected to the wiring-line pattern 24A of the substrate 24.

Next, the second connectors 23 are accommodated in the spaces partitioned by the partition walls 25U of the second case 25B, and the substrate 24 is placed on the step part 25T and the boss part 25X of the second case 25B. Note that the penetrating part 25Q of the bulging part 25K of the second case 25B and the penetrating part 23F of the base part 23A of the second connector 23 are disposed so that they are roughly aligned with each other as viewed in the Z-axis direction.

Next, the part on the Z-axis negative side of the second wire 27 is accommodated in the accommodation part 25M of the second case 25B. Then, the part between the flange parts 22A on the Z-axis negative side of the first housing 22 is accommodated inside the arm part 25L of the second case 25B. Note that the first housing 22 is disposed in the second case 25B so that the first connector 21 projects from the first housing 22 toward the X-axis negative side.

Next, the second case 25B is covered by the first case 25A so that the substrate 24 is interposed between the boss part 25W of the ceiling part 25D of the first case 25A and the step part 25T and the boss part 25X of the second case 25B, so that the side-wall part 25E of the first case 25A and the pedestal part 25J and the arm part 25L of the second case 25B are butted against each other.

In this state, the part between the flange parts 22A on the Z-axis positive side of the first housing 22 is accommodated in the first cut-out part 25G and the third cut-out part 25I of the side-wall part 25E of the first case 25A. Further, the part on the Z-axis positive side of the second wire 27 is accommodated in the second cut-out part 25H of the side-wall part 25E of the first case 25A.

Note that in the case where the first guide part 25N and the second guide part 25V are formed in the second case 25B, a predetermined part of the first case 25A and that of the second case 25B are easily butted against each other.

After that, a bolt 28 is inserted through the bolt hole 25F of the first case 25A and the bolt hole 24B of the substrate 24, and the bolt 28 is screwed into the bolt hole 25R of the second case 25B, so that the first module 2 is assembled. The above-described first module 2 has a structure in which the second housing 25 is rotatable about the first housing 22. That is, the first housing 22 and the second housing 25 constitute a hinge mechanism.

Figure 11:
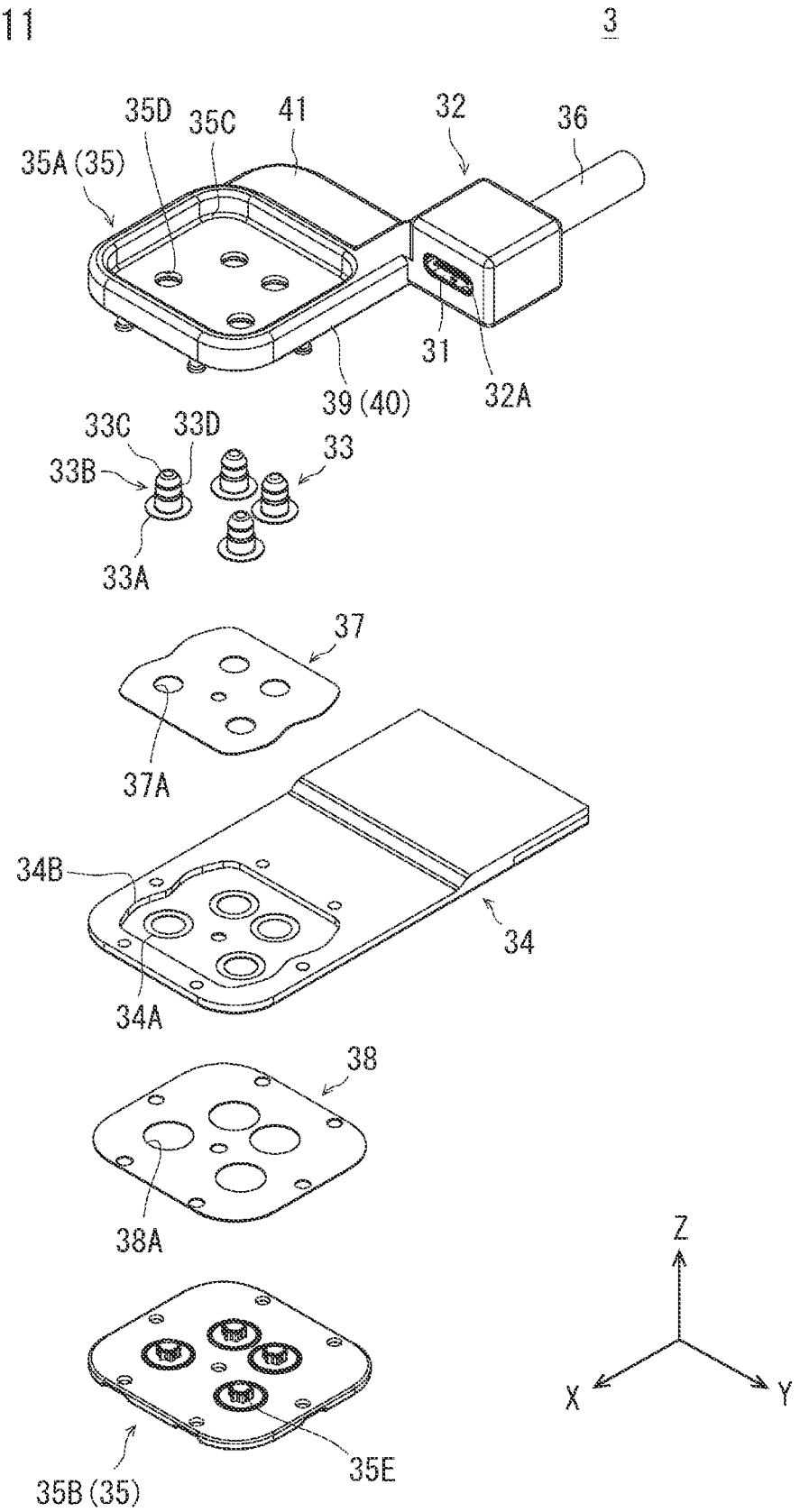
FIG. 11 is an exploded perspective view of the second module according to the embodiment as viewed from the Z-axis positive side.
Figure 12:
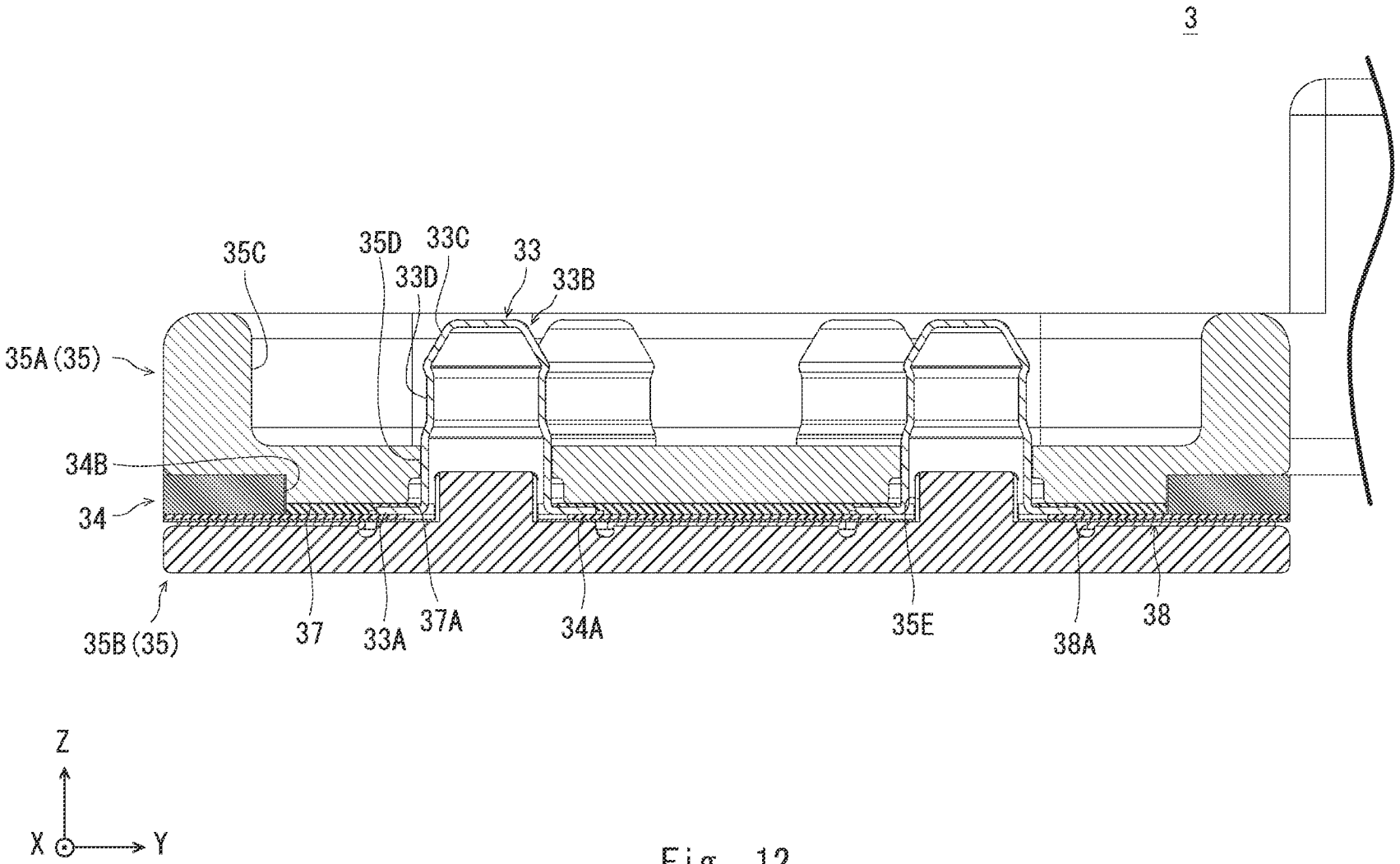
FIG. 12 is a cross-sectional view at a part indicated by arrows XII-XII in FIG. 1.

Next, a configuration of the second module 3 is described. FIG. 11 is an exploded perspective view of the second module according to this embodiment as viewed from the Z-axis positive side. FIG. 12 is a cross-sectional view at a part indicated by arrows XII-XII in FIG. 1. Note that, in FIG. 12, the drawing is partially simplified in order to clarify the drawing. As shown in FIG. 11, the second module 3 includes a third connector 31, a third housing (corresponds to the fourth housing in claim 2 of the present application) 32, a fourth connector 33, a substrate 34, and a fourth housing (corresponds to the third housing in claim 1 of the present application) 35.

The third connector 31 is mated with the first connector 21 of the first module 2. The third connector 31 is, for example, the other of the pair of micro USB Type-B connectors. However, the type of the connector is not limited to any particular type as long as the first connector 21 is able to be mated with the third connector 31. Therefore, the first connector 21 may be an earphone plug and the third connector 31 may be an earphone jack.

The third housing 32 is preferably, for example, a resin-molded article. As shown in FIG. 11, the third housing 32 has a hollow and roughly rectangular parallelepiped shape as its basic form, and an opening 32A is formed in the surface on the X-axis positive side of the third housing 32. The third connector 31 is accommodated inside the third housing 32 so that the part of the third connector 31 that is mated with the first connector 21 is exposed in the opening 32A.

Note that the third connector 31 is electrically connected to a wire 36 inserted into the third housing 32. The wire 36 extends from the third connector 31 toward the X-axis negative side. However, there is no particular restriction on the number and the arrangement of first connectors 21 of the first module 2 and third connectors 31 of the second module 3, provided that at least a pair of a first connector 21 and a third connector 31 are disposed so that they are able to be mated with each other.

The fourth connector 33 is mated with the second connector 23 of the first module 2. As shown in FIG. 11, the fourth connector 33 includes a pedestal part 33A and a pin part 33B, and is formed of a conductive material.

As shown in FIG. 11, the pedestal part 33A has, for example, an annular shape. As shown in FIGS. 11 and 12, the pin part 33B projects from the pedestal part 33A toward the Z-axis positive side. The pin part 33B has, for example, a roughly cylindrical shape in which the end on the Z-axis positive side of the pin part 33B is closed. Further, a tapered part 33C whose diameter is reduced toward the Z-axis positive side is formed at the end on the Z-axis positive side of the pin part 33B. On the outer peripheral side surface of the pin part 33B, a groove part 33D is formed so as to surround the outer peripheral side surface of the pin part 33B.

As shown in FIGS. 11 and 12, the substrate 34 has a pad part 34A on the surface on the Z-axis positive side of the substrate 34. The substrate 34 is formed of, for example, an FPC (Flexible Printed Circuit). In this case, the fourth connector 33 is fixed to the substrate 34 with a first double-sided adhesive sheet 37 interposed therebetween.

As shown in FIGS. 11 and 12, in the first double-sided adhesive sheet 37, a penetrating part 37A is formed at a place corresponding to the pad part 34A of the substrate 34. The penetrating part 37A has a diameter that is larger than the diameter of the thickest part of the pin part 33B of the fourth connector 33 and smaller than the outer diameter of the pedestal part 33A.

In a state in which the pin part 33B of the fourth connector 33 is inserted through the penetrating part 37A of the above-described first double-sided adhesive sheet 37 toward the Z-axis positive side, the surface on the Z-axis negative side of the first double-sided adhesive sheet 37 is bonded to the surface on the Z-axis positive side of the substrate 34 so that the pedestal part 33A of the fourth connector 33 is in contact with the pad part 34A of the substrate 34.

As a result, as shown in FIG. 12, the fourth connector 33 is fixed to the substrate 34 with the first double-sided adhesive sheet 37 interposed therebetween. Note that an accommodation part 34B that accommodates the first double-sided adhesive sheet 37 is preferably formed on the surface on the Z-axis positive side of the substrate 34.

In the case where the first double-sided adhesive sheet 37 is accommodated in the first accommodation part 34B of the substrate 34, the thickness of the peripheral part of the substrate 34 in the Z-axis direction is reduced as compared to the case where the accommodation part 34B of the substrate 34 is not provided. In this way, the above-described features contribute to the reduction in size of the second module 3.

Note that, for example, four fourth connectors 33 are fixed to the substrate 34 so that the fourth connectors 33 correspond to the arrangement of the penetrating parts 23F of the base part 23A of the second connector 23 of the first module 2. In such a case, the fourth connectors 33 are preferably disposed so that they are not aligned with each other in the X-axis direction. For example, the fourth connectors 33 are preferably disposed at the vertexes of an isosceles trapezoid having a short side on the X-axis negative side so that they correspond to the arrangement of the penetrating parts 23F of the base part 23A in the second connector 23 of the first module 2.

In this way, the wires on the substrate 34, which are electrically connected to the respective fourth connectors 33, are disposed so that they extend in the X-axis direction. Therefore, it is unnecessary to design the wires so as to bypass the other wires. Consequently, the above-described features contribute to the reduction in size of the substrate 34. Further, since the wires are shortened, the second module 3 is manufactured at a low cost.

Note that the penetrating parts 23F of the base part 23A of the second connector 23 of the first module 2 and the fourth connectors 33 of the second module 3 may be disposed, for example, at the vertexes of a parallelogram so that they are not aligned with each other in the X-axis direction. However, the number and the arrangement of second connectors 23 and fourth connectors 33 are not limited to those described above. That is, the only requirement is that at least a pair of a second connector 23 and a fourth connector 33 are disposed so that they are able to be mated with each other. Further, the type of the connector is not limited to any particular type as long as the second connector 23 is able to be mated with the fourth connector 33.

The fourth housing 35 is preferably, for example, a resin-molded article. As shown in FIG. 11, the fourth housing 35 includes a main-body part 35A and a lid part 35B. On the surface on the Z-axis positive side of the main-body part 35A, a recessed part 35C that is mated with the bulging part 25K of the second housing 25 of the first module 2 is formed.

As shown in FIG. 11, the recessed part 35C has, for example, a roughly rectangular shape as viewed in the Z-axis direction, and has a depth roughly equal to the height of the bulging part 25K of the second housing 25 of the first module 2 in the Z-axis direction. Further, in the bottom part of the recess 35C, a penetrating part 35D through which the pin part 33B of the fourth connector 33 is inserted is formed. The penetrating part 35D extends through the bottom part of the recessed part 35C in the Z-axis direction.

As shown in FIG. 12, the lid part 35B is fixed to the main-body part 35A in a state in which the substrate 34 is interposed between the main-body part 35A and the lid part 35B. As shown in FIG. 11, a bulging part 35E for fixing the fourth connector 33 is formed on the surface on the Z-axis positive side of the lid 35B.

Note that as shown in FIG. 12, the lid part 35B is fixed to the main-body part 35A with a second double-sided adhesive sheet 38 interposed therebetween. As shown in FIGS. 11 and 12, a penetrating part 38A through which the bulging part 35E of the lid part 35B passes is formed in the second double-sided adhesive sheet 38. The penetrating part 38A extends through the second double-sided adhesive sheet 38 in the Z-axis direction.

As shown in FIG. 12, in a state where the bulging part 35E of the lid part 35B is inserted through the penetrating part 38A of the second double-sided adhesive sheet 38 toward the Z-axis positive side, the surface on the Z-axis negative side of the second double-sided adhesive sheet 38 is bonded to the surface on the Z-axis positive side of the lid part 35B. Further, the surface on the Z-axis positive side of the second double-sided adhesive sheet 38 is bonded to the surface on the Z-axis negative side of the substrate 34 so that the bulging part 35E of the lid part 35B is inserted into the pin part 33B of the fourth connector 33.

As a result, as shown in FIG. 12, the lid part 35B is fixed to the main-body part 35A with the first double-sided adhesive sheet 37, the substrate 34, and the second double-sided adhesive sheet 38 interposed therebetween. Further, the position of the fourth connector 33 is fixed by the bulging part 35E of the lid part 35B.

Note that, as shown in FIG. 11, the fourth housing 35 is preferably integrally formed with the third housing 32. For example, the corner of the fourth housing 35 that is located on the X-axis negative side of the main-body part 35A and on the Y-axis positive side thereof is preferably fixed to the end on the Y-axis negative side of the third housing 32. In this way, the third housing 32 and the main-body part 35A of the fourth housing 35 are integrally molded, so that the third hosing 32 and the fourth housing 35 are easily manufactured.

Note that, as shown in FIG. 11, a cut-out part 39 is preferably formed by the third housing 32 and the fourth housing 35 in a region on the X-axis positive side of the second module 3 and on the Y-axis positive side thereof as viewed in the Z-axis direction. The cut-out part 39, which is described later in detail, is made to function as an accommodation part 40 for accommodating the first housing 22 of the first module 2.

Further, as shown in FIG. 11, the part that connects the third housing 32 to the fourth housing 35 is preferably made to function as a holding tab 41 at which a worker holds the second module 3 when he/she mates the first module 2 with the second module 3. The holding tab 41 connects the third housing 32 to the fourth housing 35 in the region on the X-axis negative side of the second module 3 and on the Y-axis negative side thereof. The holding tab 41 includes a flat part disposed roughly parallel to the XY-plane.

Next, a flow of assembling of the second module 3 is described. Firstly, the third connector 31 electrically connected to the wire 36 is accommodated inside the third housing 32. In this state, the part of the third connector 31 that is mated with the first connector 21 is exposed in the opening 32A of the third housing 32.

Next, in a state in which the pin part 33B of the fourth connector 33 is inserted through the penetrating part 37A of the above-described first double-sided adhesive sheet 37 toward the Z-axis positive side, the surface on the Z-axis negative side of the first double-sided adhesive sheet 37 is bonded to the surface on the Z-axis positive side of the substrate 34 so that the pedestal part 33A of the fourth connector 33 is in contact with the pad part 34A of the substrate 34. In this process, the first double-sided adhesive sheet 37 is preferably accommodated in the accommodation part 34B of the substrate 34.

Next, in a state where the bulging part 35E of the lid part 35B is inserted through the penetrating part 38A of the second double-sided adhesive sheet 38 toward the Z-axis positive side, the surface on the Z-axis negative side of the second double-sided adhesive sheet 38 is bonded to the surface on the Z-axis positive side of the lid part 35B. Further, the surface on the Z-axis positive side of the second double-sided adhesive sheet 38 is bonded to the surface on the Z-axis negative side of the substrate 34 so that the bulging part 35E of the lid part 35B is inserted in the pin part 33B of the fourth connector 33.

After that, the second module 3 is assembled by bonding the surface on the Z-axis positive side of the first double-sided adhesive sheet 37 to the surface on the Z-axis negative side of the main-body part 35A of the fourth housing 35 so that the pin part 33B of the fourth connector 33 is inserted in the penetrating part 35D of the main-body part 35A of the fourth housing 35.

Figure 13:
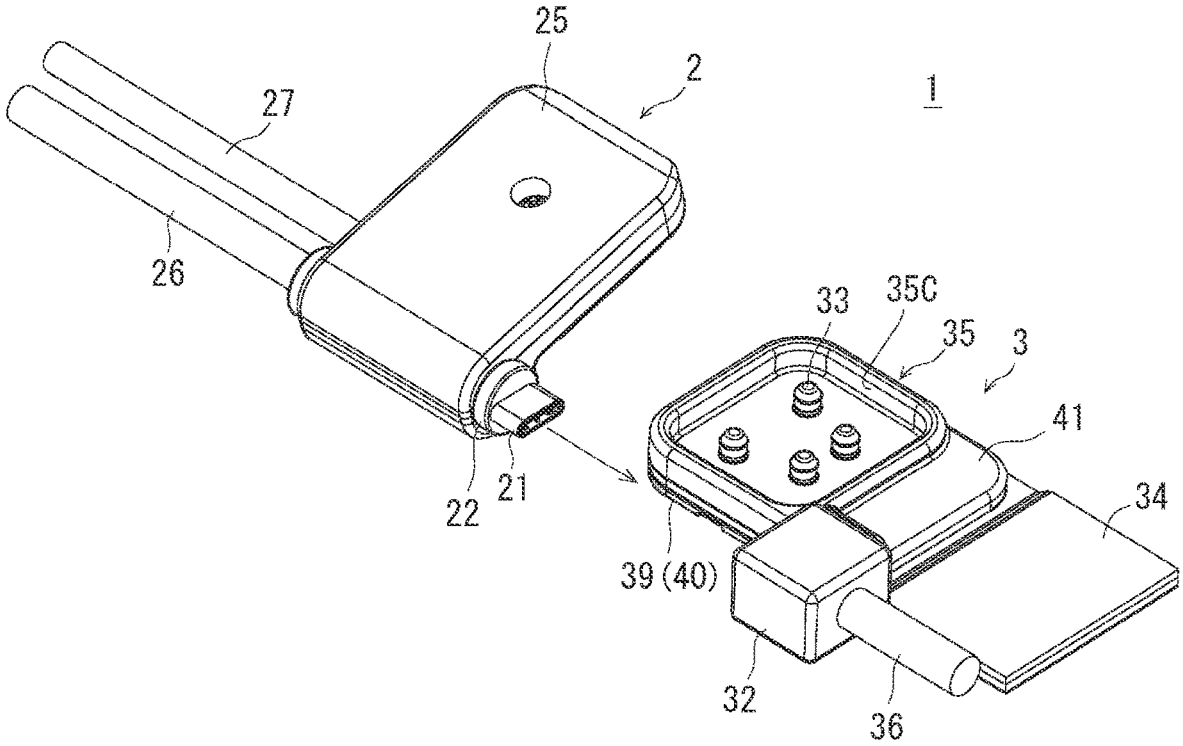
FIG. 13 is a perspective view of a composite connector according to an embodiment, showing a state in which a first connector of a first module is mated with a third connector of a second module.
Figure 14:
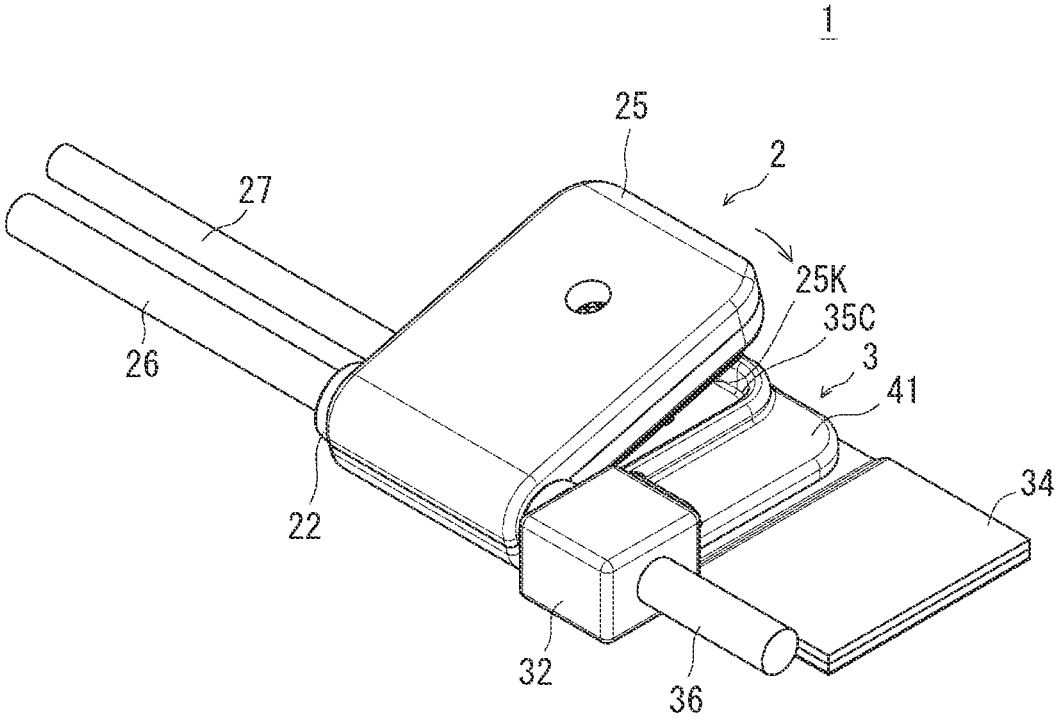
FIG. 14 is a perspective view of the composite connector according to the embodiment, showing a state in which a second connector of the first module is mated with a fourth connector of the second module.
Figure 15:
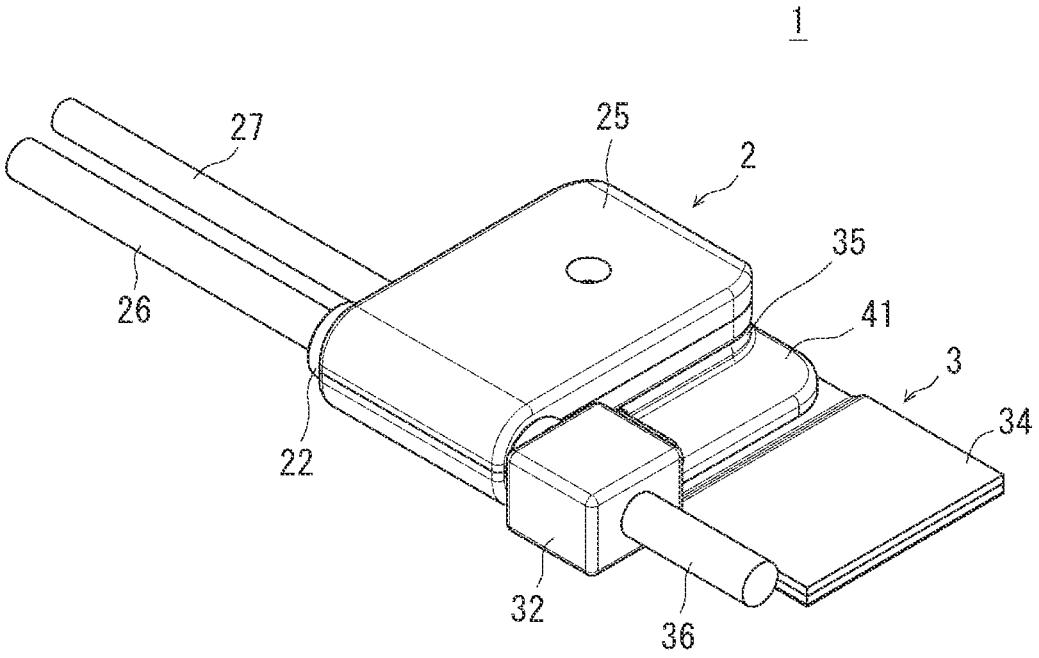
FIG. 15 is a perspective view of the composite connector according to the embodiment, showing a state in which the first module is mated with the second module.
Figure 16:
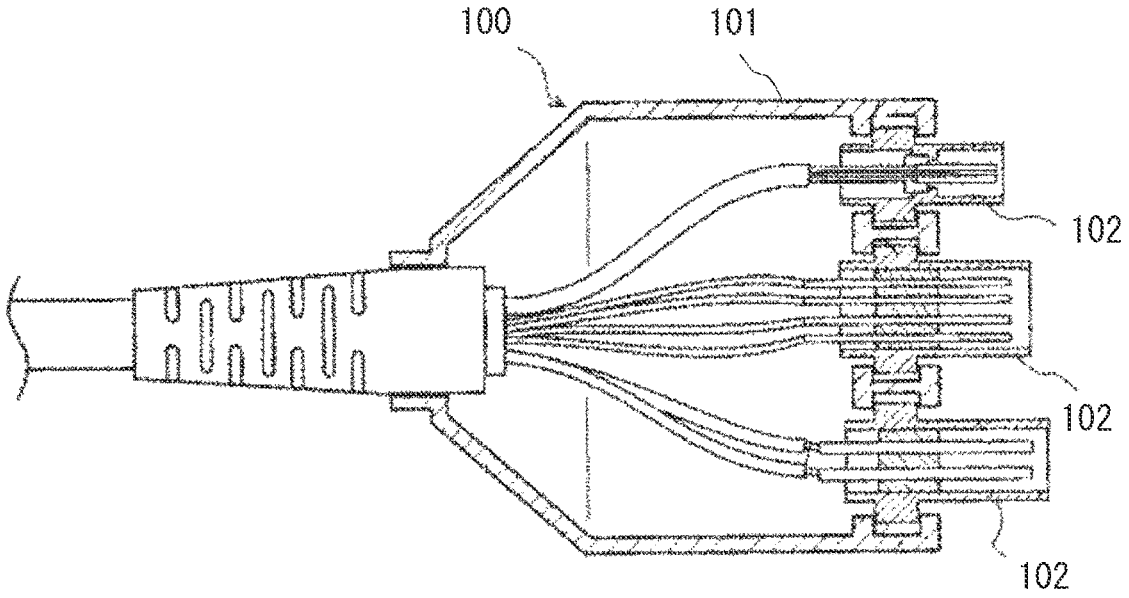
FIG. 16 shows FIG. 1(A) of Japanese Unexamined Patent Application Publication No. 2012-138244.

Next, a flow of mating of the first module 2 and the second module 3 is described. FIG. 13 is a perspective view of the composite connector according to this embodiment, showing a state in which the first connector of the first module is mated with the third connector of the second module. FIG. 14 is a perspective view of the composite connector according to this embodiment, showing a state in which the second connector of the first module is mated with the fourth connector of the second module. FIG. 15 is a perspective view of the composite connector according to this embodiment, showing a state in which the first module is mated with the second module.

As shown in FIG. 13, firstly, the first connector 21 of the first module 2 is mated with the third connector 31 of the second module 3. In this way, the positions of the first module 2 and the second module 3 in the direction in which the central axis AX1 of the first housing 22 of the first module 2 extends are fixed.

Note that in the case where the cut-out part 39 (i.e., the accommodation part 40) is formed by the third housing 32 and the fourth housing 35 of the second module 3, the first housing 22 of the first module 2 is accommodated in the accommodation part 40. Therefore, the first housing 22 is disposed by effectively using the dead space formed between the third housing 32 and the fourth housing 35, so that the size of the composite connector 1 is reduced.

Further, in the case where the holding tab 41 is provided in the second module 3, a worker mates the first connector 21 of the first module 2 with the third connector 31 of the second module 3 while holding the holding tab 41 and thereby stabilizing the second module 3.

Next, as shown in FIG. 14, the second housing 25 is rotated around the first housing 22 of the first module 2 so that the bulging part 25K of the second housing 25 of the first module 2 is mated with the recessed part 35C of the fourth housing 35 of the second module 3.

Note that since the first housing 22 is interposed between the first case 25A and the second case 25B of the second housing 25 so that the second housing 25 is rotated with respect to the first housing 22, the second housing 25 is easily rotated around the first housing 22.

As shown in FIG. 15, the first module 2 is mated with the second module 3 by further rotating the second housing 25 around the first housing 22 of the first module 2, inserting the pin part 33B of the fourth connector 33 of the second module 3 through the penetrating part 25Q of the bulging part 25K of the second housing 25 of the first module 2, and mating the pin part 33B of the fourth connector 33 with the pair of contact-point parts 23C of the second connector 23 of the first module 2.

In this process, the pair of contact-point parts 23C of the second connector 23 of the first module 2 are mated with the groove part 33D of the pin part 33B of the fourth connector 33 of the second module 3. In this way, the fourth connector 33 of the second module 3 is reliably connected to the second connector 23 of the first module 2.

Further, the peripheral part of the bulging part 25K of the pedestal part 25J of the second housing 25 of the first module 2 comes into contact with the peripheral part of the recessed part 35C of the main-body part 35A of the fourth housing 35 of the second module 3.

At the same time, the gasket 25C provided on the bulging part 25K of the second housing 25 of the first module 2 comes into contact with the peripheral side surface of the recessed part 35C of the fourth housing 35 of the second module 3. In this way, foreign substances are prevented from entering the mating part between the second connector 23 of the first module 2 and the fourth connector 33 of the second module 3.

Further, even if the pair of contact-point parts 23C of the second connector 23 of the first module 2 are pushed onto the pin part 33B when the pair of contact-point parts 23C are mated in the groove part 33D of the pin part 33B of the fourth connector 33 of the second module 3, the pair of contact-point parts 23C come into contact with the contact guide part 23E and thereby are supported by the contact guide part 23E. Therefore, the pair of contact-point parts 23C are reliably mated with the pin part 33B.

Note that when the part on the Y-axis negative side of the side-wall part 25P of the second housing 25 of the first module 2 that is located on the Z-axis negative side with respect to the groove part 25S is located on the Y-axis positive side with respect to the part on the Y-axis negative side of the side-wall part 25P that is located on the Z-axis positive side of the groove part 25S, the bulging part 25K of the second housing 25 of the first module 2 is mated with the recessed part 35C of the fourth housing 35 of the second module 3 without causing the bulging part 25K of the second housing 25 of the first module 2 to interfere with the recessed part 35C of the fourth housing 35 of the second module 3.

Therefore, the part on the Y-axis negative side of the side-wall part 25P of the second housing 25 of the first module 2 that is located on the Z-axis negative side with respect to the groove part 25S is made to function as a relief part 42 (see FIG. 5) for preventing mutual interference when the bulging part 25K of the second housing 25 of the first module 2 is mated with the recessed part 35C of the fourth housing 35 of the second module 3.

Further, the pair of contact-point parts 23C of the second connector 23 of the first module 2 extend roughly in a direction perpendicular to the central axis AX1 of the first housing 22. Therefore, when the second connector 23 of the first module 2 rotates around the central axis AX1 of the first housing 22, the pin part 33B of the fourth connector 33 of the second module 3 is smoothly guided into the space between the pair of contact-point parts 23C.

In addition, even if the mating position of the fourth connector 33 with respect to the second connector 23 is deviated from the predetermined position in the direction perpendicular to the central axis AX1 of the first housing 22, the deviation of the mating position of the fourth connector 33 with respect to the second connector 23 is absorbed (i.e., allowed). Therefore, the second connector 23 is reliably mated with the fourth connector 33.

Further, the second connector 23 of the first module 2 includes the displacement allowance part 23K. Therefore, even if the mating position of the fourth connector 33 to the second connector 23 is deviated from the predetermined position in the direction in which the central axis AX1 of the first housing 22 extends, the deviation of the mating position of the fourth connector 33 with respect to the second connector 23 is absorbed (i.e., allowed) as the displacement allowance part 23K is elastically twisted and deformed. Therefore, the second connector 23 is reliably mated with the fourth connector 33.

Further, when the first module 2 and the second module 3 are unmated, a flow opposite to the above-described flow may be performed.

As described above, in the composite connector 1 according to this embodiment, the mating direction of the first connector 21 of the first module 2 and the third connector 31 of the second module 3 differs from the mating direction of the second connector 23 of the first module 2 and the fourth connector 33 of the second module 3. Therefore, even if the mating position of the first connector 21 and the third connector 31 is deviated from the predetermined position, this deviation is unlikely to affect the accuracy of the mating of the second connector 23 and the fourth connector 33.

Therefore, there is no need to precisely form the first connector 21 and the second connector 23 in the first module 2 or to precisely form the third connector 31 and the fourth connector 33 in the second module 3, so that the composite connector 1 is manufactured at a low cost.

In addition, when the first connector 21 of the first module 2 is mated with the third connector 31 of the second module 3, the positions of the first module 2 and the second module 3 in the direction in which the central axis AX1 of the first housing 22 of the first module 2 extends are fixed, so that there is no need to align the second connector 23 of the first module 2 with the fourth connector 33 of the second module 3 in order to mate them with each other.

Therefore, after the first connector 21 of the first module 2 is mated with the third connector 31 of the second module 3, the second connector 23 of the first module 2 is mated with the fourth connector 33 of the second module 3 by rotating the second housing 25 of the first module 2 around the first housing 22. In this way, the composite connector 1 according to this embodiment contributes to an improvement of workability for mating connectors with each other.

Further, the bulging part 25K of the second housing 25 of the first module 2 is mated with the recessed part 35C of the fourth casing 35 of the second module 3. Therefore, even if an unexpected force is applied in the direction in which the first connector 21 of the first module 2 and the third connector 31 of the second module 3 are unmated, the first module 2 and the second module 3 are prevented from being unmated.

In the composite connector 1 according to this embodiment, in the case where the third housing 32 and the fourth housing 35 of the second module 3 are integrally formed, the third housing 32 and the fourth housing 35 are integrally molded, so that the third housing 32 and the fourth housing 35 are easily manufactured.

In the composite connector 1 according to this embodiment, in the case where the accommodation part 40 is formed by the third housing 32 and the fourth housing 35 of the second module 3, the first housing 22 is disposed in the accommodation part 40, so that the size of the composite connector 1 is reduced.

In the composite connector 1 according to this embodiment, in the case where the holding tab 41 is provided in the second module 3, a worker mates the first connector 21 of the first module 2 with the third connector 31 of the second module 3 while holding the holding tab 41 and thereby stabilizing the second module 3.

In the composite connector 1 according to this embodiment, in the case where the pair of contact-point parts 23C of the second connector 23 of the first module 2 extend roughly in a direction perpendicular to the central axis AX1 of the first housing 22, the fourth connector 33 of the second module 3 does not interfere with the rotational movement of the pair of contact-point parts 23C about the central axis AX1 of the first housing 22. Therefore, the pin part 33B of the fourth connector 33 of the second module 3 is smoothly guided into the space between the pair of contact-point parts 23C, contributing to an improvement in workability for mating of the second connector 23 with the fourth connector 33.

In the composite connector 1 according to this embodiment, in the case where the second connector 23 of the first module 2 includes the displacement allowance part 23K, even if the mating position of the fourth connector 33 with respect to the second connector 23 is deviated from the predetermined position in the direction in which the central axis AX1 of the first housing 22 extends, the deviation of the mating position of the fourth connector 33 with respect to the second connector 23 is absorbed (i.e., allowed) as the displacement allowance part 23K is elastically twisted and deformed.

From the disclosure thus described, it is obvious that the embodiments of the disclosure are preferably varied in many ways. Such variations are not to be regarded as a departure from the spirit and scope of the disclosure, and all such modifications as would be obvious to one skilled in the art are intended for inclusion within the scope of the conforming to claims.

What is claimed is:

1. A composite connector comprising:

a first module comprising a first housing in which a first connector is exposed from a distal end thereof, and a second housing rotatable about the first housing, the second housing comprising a second connector; and a second module including a third connector, and a third housing including a fourth connector, the third connector being configured to be mated with and electrically connected to the first connector, and the fourth connector being configured to be mated with and electrically connected to the second connector, wherein the composite connector is configured so that the second and fourth connectors are mated with each other in a state in which one of a projection and a recess that is formed in the second housing is mated with the other of the projection and the recess that is formed in the third housing.

2. The composite connector according to claim 1, wherein the bulging part comprises a relief part configured to prevent mutual interference when the bulging part is mated with the recessed part.

3. The composite connector according to claim 1, wherein a plurality of second connectors and a plurality of fourth connectors are disposed so that they are mated with each other in a state in which the bulging part is mated with the recessed part, and the fourth connectors are disposed so that they are not aligned with each other in a direction in which a central axis of the first housing extends in a state in which the first connector is mated with the third connector.

4. The composite connector according to claim 1, wherein the second connector comprises one of a pin part or a pair of contact-point parts in which the pin part is inserted, the fourth connector comprises the other of the pin part or the pair of contact-point parts, and the pair of contact-point parts extend in a direction perpendicular to a central axis of the first housing in a state in which the first connector is mated with the third connector.

5. The composite connector according to claim 4, wherein the second connector or the fourth connector comprising the pair of contact-point parts comprises a displacement allowance part configured to allow a displacement in a direction in which the central axis of the first housing extends in the pair of contact-point parts in a state in which the first connector is mated with the third connector.

6. The composite connector according to claim 1, wherein the second module comprises a fourth housing comprising the third connector, and the third housing and the fourth housing are integrally formed.

7. The composite connector according to claim 6, wherein the second module comprises an accommodation part configured to accommodate the first housing, and the accommodation part is a cut-out part formed by the third housing and the fourth housing.

8. The composite connector according to claim 6, wherein the second module comprises a holding tab formed so as to connect the third housing to the fourth housing.

* * * * *